US006640504B2

(12) United States Patent
Pearlson et al.

(10) Patent No.: US 6,640,504 B2
(45) Date of Patent: Nov. 4, 2003

(54) MOVEABLE SWIMMING POOL FLOOR

(75) Inventors: James Pearlson, Miami, FL (US); Raymond Pearlson, Miami, FL (US)

(73) Assignee: FLG Industries, Inc., Miami, FL (US)

( * ) Notice: Subject to any disclaimer, the term of this patent is extended or adjusted under 35 U.S.C. 154(b) by 79 days.

(21) Appl. No.: 09/950,092

(22) Filed: Sep. 10, 2001

(65) Prior Publication Data

US 2002/0062602 A1 May 30, 2002

Related U.S. Application Data

(60) Provisional application No. 60/231,910, filed on Sep. 11, 2000.

(51) Int. Cl.[7] ..... E04H 3/16

(52) U.S. Cl. ..... 52/66; 52/64; 52/169.7; 52/126.5; 4/495

(58) Field of Search ..... 52/169.7, 126.5, 52/66, 64, 105, 111; 4/495, 172.13; 187/414

(56) References Cited

U.S. PATENT DOCUMENTS

| | | | | |
|---|---|---|---|---|
| 1,101,166 A | | 6/1914 | Collins | |
| 2,970,320 A | | 2/1961 | Karp | |
| 3,091,777 A | * | 6/1963 | Pearlson | 4/172 |
| 3,435,465 A | | 4/1969 | Formel | |
| 3,553,743 A | | 1/1971 | Lodige | |
| 3,564,622 A | | 2/1971 | Meulekamp | |
| 3,668,711 A | * | 6/1972 | Liermann et al. | 4/501 |
| 3,670,343 A | * | 6/1972 | Gansloser | 4/495 |
| 3,760,432 A | | 9/1973 | Glorisi | |
| 3,935,600 A | | 2/1976 | Scribner | |
| 4,060,909 A | * | 12/1977 | Collins et al. | 33/296 |
| 4,164,047 A | * | 8/1979 | Barothy | 4/494 |
| 4,283,801 A | * | 8/1981 | Smith | 4/495 |
| 5,025,512 A | | 6/1991 | Niimura | |
| 5,271,483 A | * | 12/1993 | Hong | 187/255 |
| 5,542,502 A | * | 8/1996 | Scriven | 187/414 |
| 5,678,253 A | * | 10/1997 | Baker | 254/89 R |
| 6,105,180 A | | 8/2000 | Kramer | |
| 6,253,390 B1 | | 7/2001 | Laks | |

FOREIGN PATENT DOCUMENTS

| | | |
|---|---|---|
| EP | 0353833 | 2/1990 |
| JP | 3137361 | 6/1991 |
| JP | 9067952 | 3/1997 |

* cited by examiner

*Primary Examiner*—Carl D. Friedman
*Assistant Examiner*—Basil Katcheves
(74) *Attorney, Agent, or Firm*—Christopher & Weisberg, P.A.

(57) ABSTRACT

A vertically moveable swimming pool floor apparatus includes a rigid planar platform configured to fit the planform area of a swimming pool, and a plurality of hydraulically powered hoists coupled to the platform to raise and lower the platform. The hoists are controlled by a control system operated by the user. The hoists controllably actuate the platform into and out of a swimming pool cavity, such that effective depth of the swimming pool is variable in a continuous range. The platform is equipped with depth indicators to allow users to observe the effective depth of the pool.

6 Claims, 3 Drawing Sheets

MOVEABLE SWIMMING POOL FLOOR

CROSS-REFERENCE TO RELATED APPLICATION

This application is related to and claims priority to U.S. patent application Ser. No. 60/231,910, filed Sep. 11, 2000, entitled MOVEABLE SWIMMING POOL FLOOR, the entirety of which is incorporated herein by reference.

STATEMENT REGARDING FEDERALLY SPONSORED RESEARCH OR DEVELOPMENT n/a

FIELD OF THE INVENTION

This invention relates to an apparatus for swimming pools, namely, a vertically moveable swimming pool floor.

BACKGROUND OF THE INVENTION

Swimming pools present serious dangers to small children, the elderly, the disabled, and others who do not have the ability to swim. Because most pools are configured to accommodate both diving and swimming, the depth of a pool must be adequate to safely allow users to dive into the pool. Yet, even very shallow water can be deadly to those incapable of swimming.

Pools often provide a shallow, wading depth at one end, safe enough for non-swimmers, and provide a deeper swimming and diving depth at the opposite end. This requires greater time, effort and expense in laying out and constructing the swimming pool floor, as a sloped floor is inherently more difficult to construct than a flat one.

Nevertheless, the swimming pool presents a serious drowning hazard to small children or the disabled who may accidentally fall into the pool. Another hazard exists when the pool itself is emptied of water for cleaning or maintenance, presenting a dangerous structural cavity or pit.

It is desirable therefore, to provide a device which may effectively vary the depth of a swimming pool, without requiring the construction of a curved, sloped, or otherwise complex swimming pool shell, and which may effectively minimize the depth of a pool when such pool is emptied of water.

Furthermore, the planform area of a swimming pool may significantly decrease the usable area of a yard or other space where the pool is located. For personal and home applications, this decrease in usable planform area can be significant. Conventional devices and methods for covering a swimming pool generally use flexible thin covers such as tarpaulins. Unless a sufficiently rigid device is used to cover the pool, the planform area of the swimming pool is not effectively usable for any other purpose than as a swimming pool.

It is desirable therefore to provide a device which may render the planform area of a swimming pool usable for a purpose other than swimming or diving, where the pool is covered by a rigid medium suitable for walking, sitting, or playing thereupon.

SUMMARY OF THE INVENTION

A vertically moveable swimming pool floor apparatus includes a rigid planar platform configured to fit the panform area of a swimming pool, and a plurality of hydraulically powered hoists coupled to the platform to raise and lower the platform. A number of depth indicators are attached to the platform. A control system is coupled to the hoists to monitor and control the movement and position of the platform.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
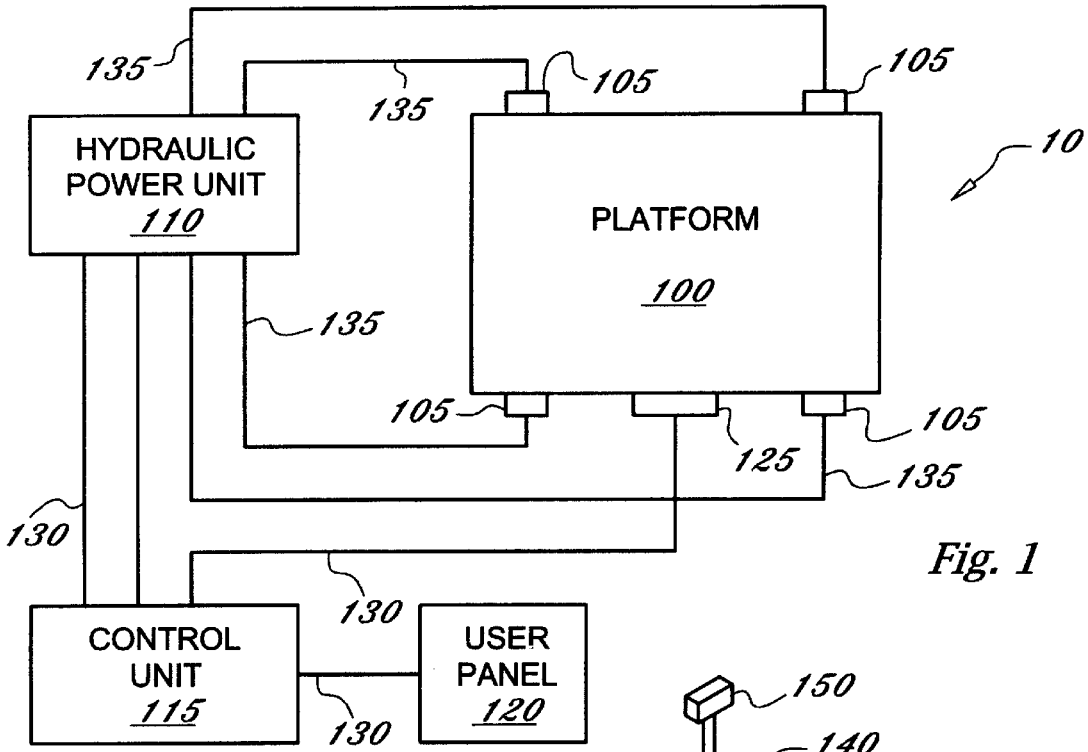
FIG. 1 is a diagram of the moveable swimming pool floor apparatus system.

FIG. 1 illustrates the moveable swimming pool floor apparatus as integrated with a power and control system, labeled generally as 10. The moveable swimming pool floor apparatus and system includes a platform 100, a plurality of hoists or hoist assemblies 105, a hydraulic power unit 110, a control unit 115, a user panel 120, a depth sensor 125, communications media 130, and a number of hydraulic power lines 135.

The platform 100 is coupled to a number of hoists 105. In FIG. 1, four such hoists 105 are positioned around a rectangular platform 100. The platform 100 may be of any shape suitable to conform to the particular planform area of the swimming pool into which the apparatus is to be installed. The hoists 105 are hydraulically powered rotary hoists, configured to generate torque to power a strap or other mechanical pulling medium (not shown) coupled to the platform. The platform 100 is configured to be moved by the action of the hoists 105 in a direction into and out of the plane of platform 100.

The hoists 105 are coupled via power lines 135 to the hydraulic power unit 110. The power unit 110 is any suitable hydraulic or pneumatic power assembly, capable of providing sufficient hydraulic power through lines 135 to meet the loads presented.

The hydraulic power unit 110 is in turn coupled via communications medium 130 to the control unit 115, which may also be coupled to a depth sensor 125 via another, separate communications medium. The communications media 130 are any device capable of sending or receiving data in electronic form, either analog or digital, wired or wireless, suitable to allow control system 115 to send and receive electronic commands and responses from the power unit 110 or depth sensor 125.

The hoist assemblies 105 also comprise an automatic braking system (not shown) configured to detect undesired movements of the platform 100, or individual hoists 105, such that the actuation of one or all of the hoists 105, and hence the movement of platform 100, is arrested in response to the detection of an undesired movement characteristic of the platform 100. This undesired movement characteristic may be predetermined based on any number of criteria, such as excessive movement speed of the platform 100 when it is being raised or lowered by the hoists 105, or the detection of an obstruction or hazard around the apparatus.

The user panel 120 contains a number of switches, gauges, and indicators to allow a user to independently control and monitor each or all of the hoists 105, as well as to monitor the relative depth of the platform 100 as measured and communicated by depth sensor 125. The user panel 120 is connected to the control unit 115, which receives commands and input from the user panel 120 to relay to the power unit 110. The control unit has mechanical, electrical, or electromechanical components capable of controlling (i) the starting and stopping of each of the individual hoists 105; (ii) the speed at which each of the individual hoists 105 are actuated, such that the platform 100 is movable at a nominal speed of about one foot per minute; (iii) additional air-powered shut-off devices located in the apparatus, capable of arresting the action of an individual hoist 105, platform 100, or both, when the platform is positioned at a predetermined point, such as near the very top of its range of motion near the top or coping of the swimming pool, or near the very bottom of its range of motion near the floor of the swimming pool.

Figure 2:
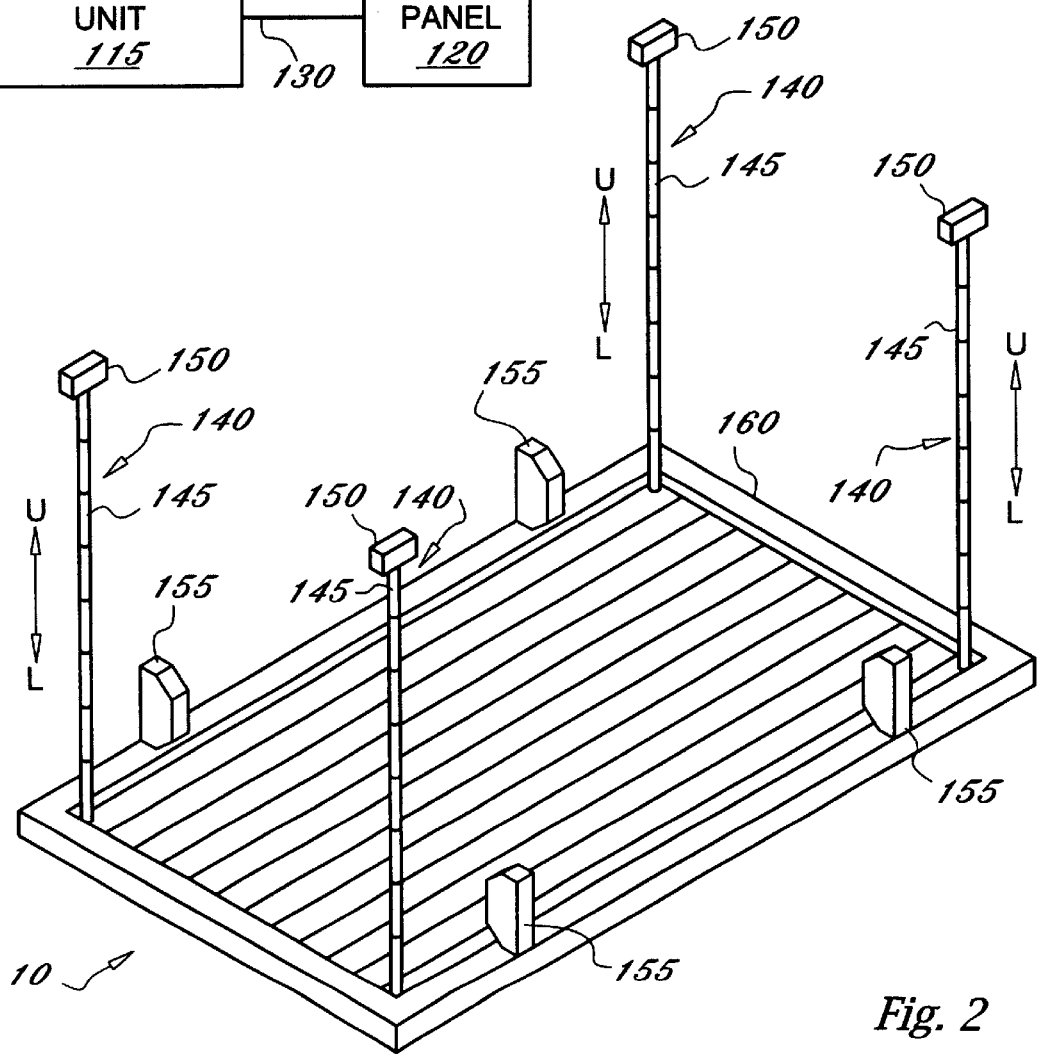
FIG. 2 is a perspective view of the apparatus inside a swimming pool.

FIG. 2 illustrates the apparatus 10 as installed in a swimming pool of characteristic size and shape. In addition to the platform 100, FIG. 2 shows the layout and positioning of a number of elements incorporated into the apparatus 10, namely, a number of depth indicators 140, each including an elongate member or pole 145 topped with a warning sign 150 and coupled to each of the four corners of the platform 100, and a number of hoist assembly covers 155, each covering a hydraulic hoist 105 (not shown). The hoists 105 are positioned opposite each other at two lateral lines across the shorter side of the platform 100. Coping 160 circumscribes the platform and pool cavity (not shown).

The platform 100 is shown in FIG. 2 at its uppermost position, wherein it may effectively function as a swimming pool cover and may be usable floor space for a number of applications. The platform is moved up in the direction U and down in the direction L, as shown in FIG. 2. The platform is constructed of lightweight materials having a high modulus of elasticity, having a normal compressive strength that is sufficient to withstand the load of several people as well as commonly used objects such as tables, lawn chairs, barbeques, and the like. The platform 100 may be constructed of any materials suitable and robust enough to meet the foregoing criteria, such as PVC, structural aluminum, stainless steel, carbon fiber, or other rigid, workable material.

The depth indicators 140 are constructed with at least one elongate pole 145, having a number of markings affixed longitudinally thereon to show linear dimension in the directions U and L. A sign 150 having a suitable warning message is fixed to the top of each pole 145. The poles 145 are detachably fixed to the platform 100 in the corners as shown, and may be rigid or semi-rigid. As the platform 100 is actuated up or down in the directions U or L, respectively, the depth indicators 140 move with the platform 100 in such direction. An observer may ascertain the depth at which the platform 100 is lowered into the pool cavity relative to a reference level by viewing the position of such reference level next to the dimensional markings affixed on any of the poles 140. The reference level may be the pool coping 160, or any other reference height chosen by the user so generally correspond with the maximum height of the water level in the swimming pool.

In the alternative, the pole 145 may be a telescoping pole, such that the signs 150 are configured to be indicator gauges, coupled to a depth sensor disposed inside of the poles 145. The signs 150 are then fixed at a reference height relative to the pool, and do not move as the platform 100 is moved. Instead, as the platform 100 is lowered into the pool, the poles 145 telescope downwards with the platform 100 and relay a depth indication to the signs 150, which are then observed to ascertain pool depth.

Figure 3A:
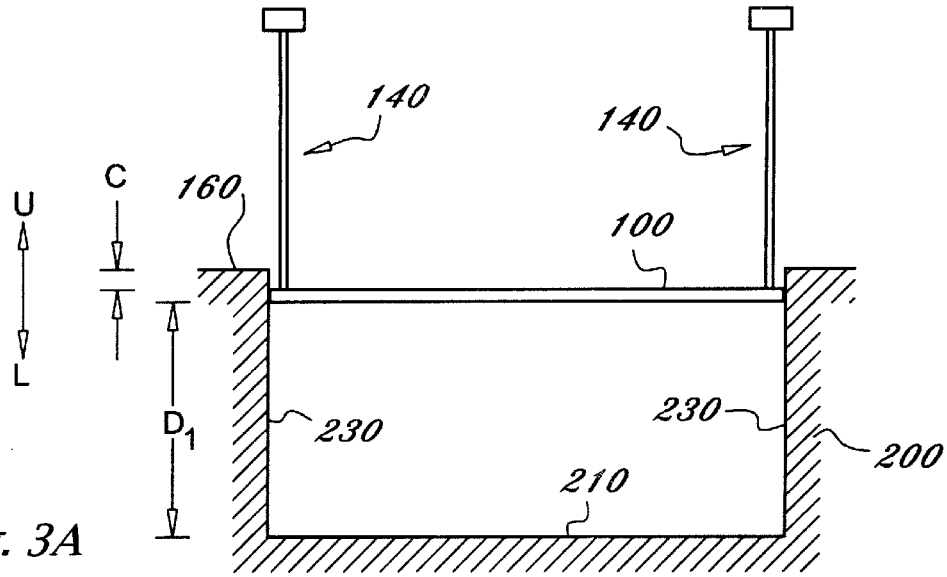
FIGS. 3A, 3B, and 3C are cross-sectional views of the apparatus with the platform at varying depths.
Figure 3B:
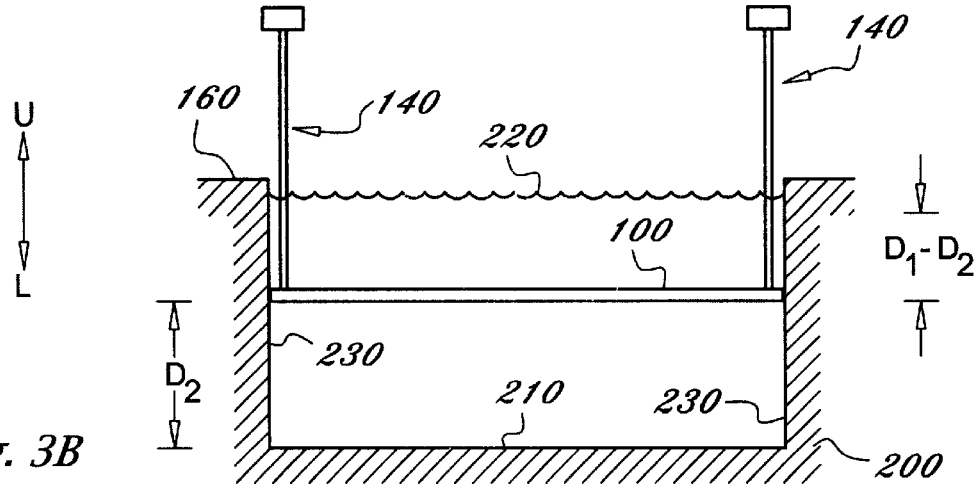
Figure 3C:
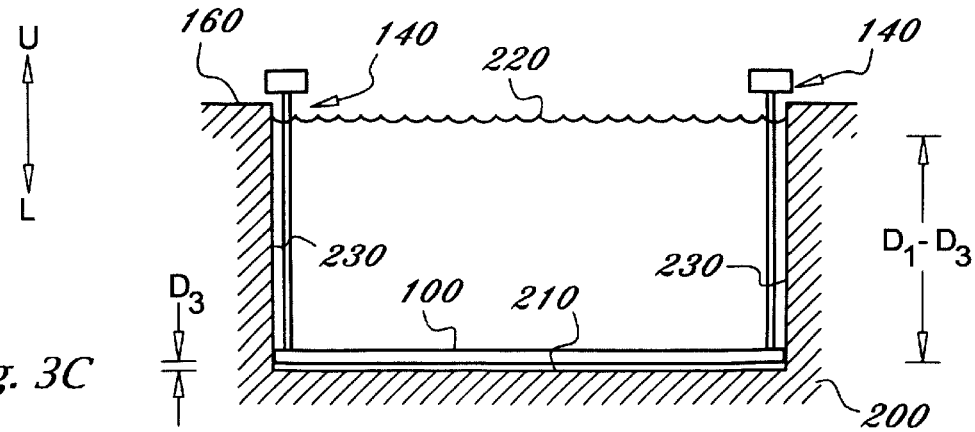

FIGS. 3A, 3B, and 3C show the platform 100 in its uppermost, intermediate, and lowermost stages, respectively, as it descends into a swimming pool cavity 200. At its upper most stage, the platform 100 is at a depth $D_1$ above the swimming pool floor 210, as shown in FIG. 3A. At such a position, a nominal clearance C exists between the platform 100 surface and the very top of the coping 160. FIG. 3A shows the platform 100 at its uppermost position when the device is used as a pool cover or usable floor space, and no water is in the pool cavity 200.

As the platform is lowered in the direction L, it reaches an intermediate position $D_2$ above the floor 210, as shown in FIG. 3C. Here the water level 220 is shown at a level corresponding to a height $D_1$ above the floor 210, such that the effective depth of water (and hence the usable swimming pool) is: $(D_1-D_2)$. The vertical position of platform 100 is continuously variable by the action of the hoists 105 and control unit 115 as indicated in FIG. 1, such that the effective swimming pool depth $(D_1-D_2)$ is continuously variable.

When the platform 100 is lowered the maximum amount into cavity 200, the top surface of platform 100 rests at a small clearance $D_3$ above the floor 210 (including the thickness of the platform 100 itself), such that the effective swimming pool depth is at its maximum amount: $(D_1-D_3)$.

A flexible, resilient seal (not shown), made of a material such as rubber, is disposed around the platform 100, in the plane of the platform 100, and mates the edges of the platform 100 with the sides 230 of pool cavity 220. The platform 100 itself is also constructed to have a number of fluid-permeable joints and seals (not shown), such that water can easily travel through such joints and seals to allow the platform 100 to be moved without encountering excessive compressive, expansive, or drag resistance from the water 220 as the platform 100 moves therethrough.

Not shown in FIGS. 3A, 3B, and 3C are the hydraulically actuated shutoff mechanisms positioned near the top and bottom of the pool cavity 200, such that each mechanism is activated when the platform 100 is in its uppermost position, as in FIG. 3A, and its lowermost position, as in FIG. 3C. In such cases, when the platform 100 has been moved to such a position, the action of the hoists 105, and hence the platform 100, is halted for safety and efficiency considerations.

Figure 4:
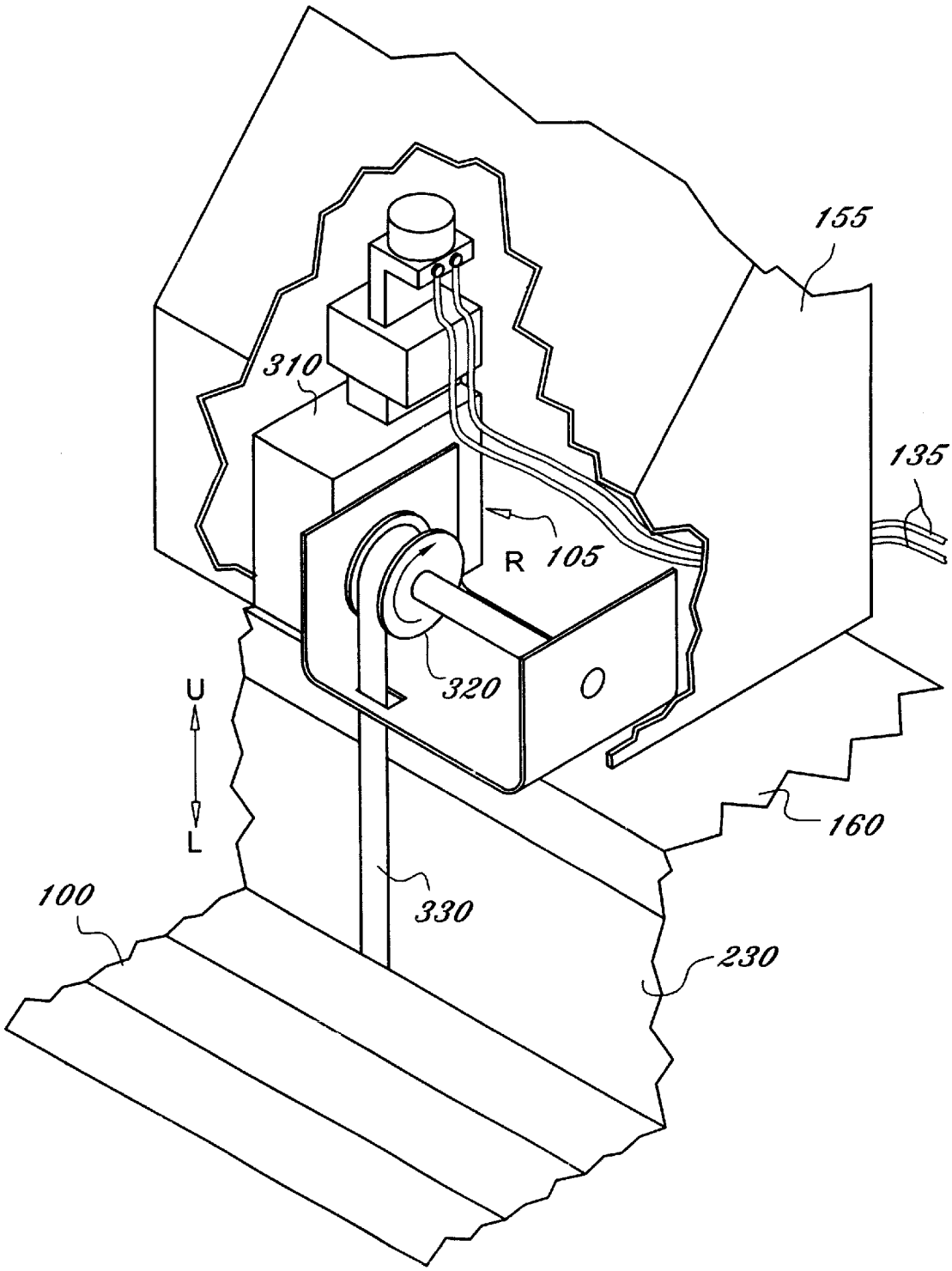
FIG. 4 is a cutaway perspective view of a hydraulic hoist assembly.

FIG. 4 shows a cut-away view of a hoist assembly 105, with the hoist assembly cover 155 cut-away to show detail. The hoist assembly 105 includes an actuation unit 310, coupled to the hydraulic power lines 135, and engaged to a rotary spindle 320, which houses and wraps a strap 330, connected at its distal end to the platform 100. The entire hoist assembly 105 and cover 155 are fixedly attached to the coping 160, wherein the strap 330 is positioned to run vertically very near to the edge of the swimming pool sides 230. The hoist assembly 105 is hydraulically powered via power lines 135, such that when the actuator unit 310 engages the spindle to rotate in the direction R shown in FIG. 4, the platform 100, moves up in the direction U. The mere force of gravity, coupled with a possible resistive drag from the actuation of the hoist 105 and spindle 320 in the direction opposite R, allows the platform 100 to be lowered in the direction L at a safe, controlled speed.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A vertically moveable swimming pool floor apparatus, comprising:

a rigid substantially planar platform configured to fit a platform area of a swimming pool, and a plurality of hydraulically powered hoists coupled to the platform to raise and lower the platform; and at least one depth indicator coupled to the platform wherein the at least one depth indicator comprises an elongate rigid member having:

a length, proximal and distal end portions, the proximal end portion being coupled to the platform, the distal end portion being coupled to a sign, and a plurality of markers visibly affixed along the elongate rigid member, the markers being spaced along the length at predetermined intervals to indicate actual linear dimension; and wherein the elongate rigid member is fixedly coupled substantially perpendicular to the platform.

2. The apparatus of claim 1, wherein the platform is substantially rectangular, having four corners, and wherein one each of the at least one depth indicators is coupled to the platform at each corner.

3. The apparatus of claim 1, further comprising a control system coupled the plurality of hoists to lower and raise the platform in response to a user command.

4. The apparatus of claim 3, wherein the control system is coupled to the apparatus via a wireless communications medium.

5. The apparatus of claim 3, wherein the apparatus further comprises at least one depth sensor electronically coupled to the depth indicator to indicate the depth of the platform relative to a reference level.

6. The apparatus of claim 3, wherein the control system further comprises an automatic braking system coupled to each of the at least one hoists, the automatic braking system being configured to arrest the movement of the platform in response to a predetermined movement criterion.

* * * * *